US005328647A

United States Patent [19]

Koob

[11] Patent Number: 5,328,647

[45] Date of Patent: Jul. 12, 1994

[54] PROCESS TO SEAL STRUCTURAL JOINTS

[75] Inventor: Kunibert Koob, Alpen, Fed. Rep. of Germany

[73] Assignee: BBZ Betonbau-Zubehör-Handelsgesellschaft mbH, Willich, Fed. Rep. of Germany

[21] Appl. No.: 912,178

[22] Filed: Jul. 13, 1992

[30] Foreign Application Priority Data

Jul. 12, 1991 [DE] Fed. Rep. of Germany ..... 4123067

[51] Int. Cl.[5] ..... E04B 1/16; E04G 21/04; E04G 23/02; B32B 35/00

[52] U.S. Cl. ..... 264/34; 52/741.3; 52/741.4; 264/35; 264/36; 264/39; 264/40.1; 264/85; 264/101; 405/267

[58] Field of Search ..... 264/31-36, 264/39, 85, 101, 308, 40.1; 52/743, 744, 741.1, 741-741.4; 138/97, 98; 405/107, 108, 267, 266

[56] References Cited

U.S. PATENT DOCUMENTS

| | | | |
|---|---|---|---|
| 2,313,110 | 3/1943 | Wertz | 264/36 |
| 2,560,619 | 7/1951 | Wertz | 264/31 |
| 3,272,894 | 9/1966 | Roach | 264/36 |
| 4,499,925 | 2/1985 | Kaufmann | 138/125 |
| 4,722,479 | 2/1988 | Koob . | |
| 4,758,295 | 7/1988 | Sawaide et al. | 264/36 X |
| 5,000,890 | 3/1991 | DiStefano et al. | 264/35 |
| 5,056,282 | 10/1991 | Pflieger | 138/97 X |

FOREIGN PATENT DOCUMENTS

| | | | |
|---|---|---|---|
| 2510470 | 10/1976 | Fed. Rep. of Germany . | |
| 8425518 | 11/1984 | Fed. Rep. of Germany . | |
| 3320875 | 12/1984 | Fed. Rep. of Germany . | |
| 3512470 | 10/1986 | Fed. Rep. of Germany . | |
| 52505 | 5/1978 | Japan | 425/225 |
| 276349 | 10/1951 | Switzerland . | |

*Primary Examiner*—Karen Aftergut

*Attorney, Agent, or Firm*—Wenderoth, Lind & Ponack

[57] ABSTRACT

A structural joint is sealed with the aid of an injection hose including a substantially liquid-impermeable base body which envelops a passage channel and which has exit openings distributed over the length of the base body for passage of injection liquid from the passage channel into the joint to be sealed. The exit openings open under internal excess pressure and I close under internal negative pressure. Following injection of the injection liquid into the joint to be sealed, the injection liquid remaining in the injection hose is drawn off from the passage channel.

10 Claims, 1 Drawing Sheet

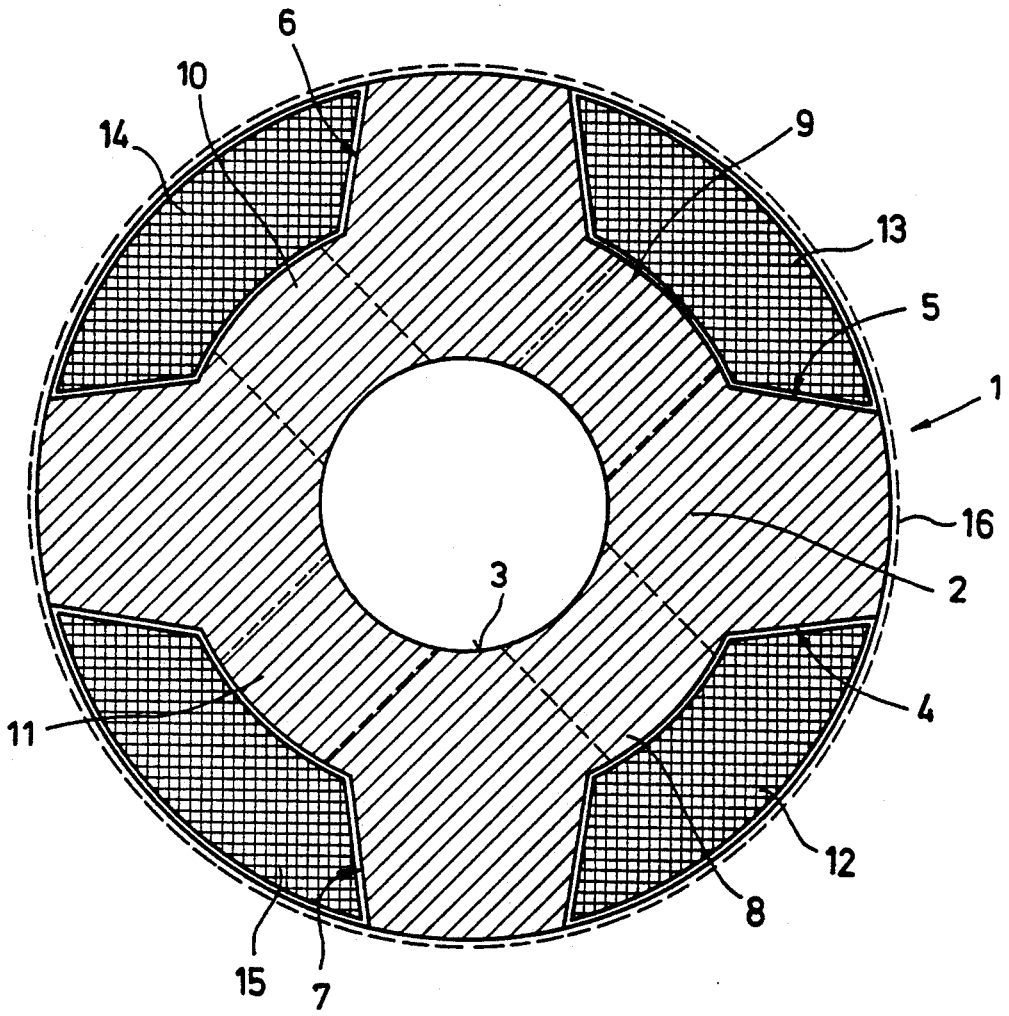
6
10
14
9
13
5
1
16
2
3
4
11
12
8
15
7

PROCESS TO SEAL STRUCTURAL JOINTS

BACKGROUND OF THE INVENTION

The invention relates to a process to seal structural joints with the aid of an injection hose comprising a substantially liquid-impermeable base body which defines a passage channel and which has exit openings distributed over the length of the base body for the passage of an injection liquid from the passage channel into a joint to be sealed.

The reliable and permanent seal of construction or expansion joints in structures, especially in concrete structures, presents a general problem. Due to the lack of space and traffic problems, construction is done increasingly underground, especially in densely populated areas. Typical examples are underground garages or underground streets. The reliable function and stability of these structures are largely dependent on their tightness with respect to penetrating water, and for this reason the majority of such structures currently are built of water-impermeable concrete. The concrete structure must ensure, in addition to its basic supporting and enveloping function, the function of satisfactory sealing. In so doing, the configuration and design of the construction and expansion joints thereof become important with regard to tightness and impermeability.

Conventional joint guarantees frequently do not fulfill the demands imposed on them, resulting in considerable costs for cleaning and/or repairing leaky joints or cracks. For this reason, injection hoses of the type specified in DE-OS 35 12 470, DE-OS 33 20 875 and DE-GM 84 25 518 were developed to be built into the construction joints and through which an injection liquid is injected into the joint region in order to ensure that it will be water-tight. The injection process employs an injection hose and occurs usually when the curing of the concrete and thus the relaxation behavior typical of such building material has terminated. The injection liquid is injected into a passage channel of a substantially water-impermeable base body of the injection hose, from which it can issue through exit openings into the vicinity of the joint. The exit openings are covered as shown in DE-OS 25 12 470 or by means of strips that are made of compressible material and that are embedded in depressions disposed on the outside of the base body. The injection hose is held together by means of a hose or covering that is made of a liquid-permeable material and that envelops the base body and the strips. Owing to the injection pressure, the strips are compressed and the joints between the depressions and the strips are expanded in such a manner that the injection liquid can issue from the injection hose. Then the injection liquid can be left to harden, resulting usually in the joint being sealed by means of the injection liquid that has issued from the injection hose. However, the injection liquid also hardens in the hose interior, and it is impossible to check the quality of the seal. If in the course of time the interior of the structure shifts and thus the imperviousness of the joint is lost or, for example, the concrete cracks due to an overload, it no longer is possible to again pressure grout into the joint or crack, since the joint or crack no longer is accessible with the injection hose. Occasionally, it also happens that during initial pressure grouting the joint had large cavities or leaks, into which or through which large amounts of injection material have escaped laterally. Due to resultant pressure loss, the injection material could not reach all such joint regions, and porosity of the joint remained. In such case also, with the known method of using injection hoses it is not possible to seal subsequently the joint and check the joint seal for completion.

SUMMARY OF THE INVENTION

Therefore, the object of the invention is to ensure the quality and/or be able to check the seal of a joint formed by injection of an injection liquid, even over a prolonged period of time.

This object is achieved by the invention in that the injection hose used has exit openings that open under internal excess pressure and that close under internal negative pressure, and that, following injection of the injection liquid into the joint to be sealed, the injection liquid remaining in the injection hose is drawn off before the liquid hardens.

It is possible to draw off the injection liquid from the injection hose, for example an injection hose according to DE-OS 35 12 470, because the strips covering the exit openings are pulled shut on the base body by the negative pressure that is generated while drawing off the injection liquid, thus sealing the injection hose with respect to the joint. Therefore, injection liquid that issued from the hose during the previous injection process remains outwardly of the hose, even though it is still liquid, in the joint and is not drawn off with the liquid from the interior of the hose.

After the injection liquid located in the injection hose is drawn off, the passage channel is free again and the injection hose is available for another injection operation. By means of a post-injection of injection liquid, the joint regions that were not completely filled during the first injection operation can be filled immediately following the first injection operation. But post-injection also can be conducted after a more or less longer period of time, should the joint have been demonstrated to be porous or in the course of time new cavities or cracks are to be filled and sealed with injection liquid. Even the injection liquid remaining in the injection hose during the post-injection operation can be drawn off again from the injection hose under the same conditions as during the first injection operation, so that the hose is available for reuse.

After emptying the injection hose of the injection liquid following the first or subsequent injection operation and hardening of the injection liquid in the joint to be sealed, it is also possible to introduce water under specific pressure (for example by connecting to a water line a public supply network) into the injection hose. In this manner the imperviousness of the joint can be checked. Such checking for water-tightness can also be repeated at arbitrary time intervals.

So that a reinjection operation or an operation of testing or checking for imperviousness is not prevented by residual injection liquid that has remained in the injection hose and, having hardened, plugged the hose, it is important to remove the injection liquid as completely as possible from the injection hose. This can be done, according to the invention, in an advantageous manner by means of application of partial suction pressure. To remove completely the residual injection liquid remaining in the injection hose from the hose, the injection hose can also be rinsed with water and/or compressed air can be blown therethrough after the injection liquid has been drawn off.

The post-injection operation effected according to the invention, in order to seal totally or reseal the construction joints immediately after the injection liquid has hardened in the joint region or after a prolonged period of time, is carried out advantageously at a higher pressure than is the first injection operation. It has turned out that by means of such post-injection operation at raised pressure, even previously non-injected regions in the vicinity of the injection hose or even small pores or structural defects can be filled individually.

The imperviousness of the joint can be checked or tested with water under pressure, preferably according to the invention in such a manner that the pressure is maintained over a prolonged period of time, for example for a few days. Thus, a reliable judgement concerning the imperviousness of the joint can be made.

In accordance with another preferred feature of the invention, synthetic resins which harden reactively and can be mixed with water, resins based on vinyl ester, polyurethane resins, or ultrafine mortar with liquid additives can be used as the injection liquid. Even epoxy resins are suitable. Desired are injection materials which swell when stressed with water, thus additionally supporting the sealing of the joints and cracks. This swelling can be almost reversed by drying out the injection material. Injection liquids based on silicate mortar with hardening systems suitable for a particular application also are conceivable. Both vinyl ester-based resins and ultrafine mortar are water soluble in the fresh state, so that emptied injection hoses and apparatuses easily can be cleaned by rinsing with water and are then available again for post-injection, which may or may not be necessary, or for checking or testing the impermeability of a joint. Polyurethane resins that also can be used as the injection liquid are not water soluble. Therefore, they are post-injected, according to the invention, preferably only within the curing time thereof. With this injection medium the hose system is less easy to clean. It is within the scope of the invention to use different injection liquids for the individual injection operation.

BRIEF DESCRIPTION OF THE DRAWING

Other objects, features, advantages and possible applications of the invention will be apparent from the following description of embodiments of the invention, with reference to the accompanying drawing. All described and/or graphically illustrated features form for themselves or in any arbitrary logical combination the subject matter of the invention, independently of their summary in the claims.

The sole FIGURE is a cross sectional view of an injection hose which can be used preferably for the process of the invention.

DETAILED DESCRIPTION OF THE INVENTION

An injection hose 1 includes a base body 2 having a substantially hollow cylindrical wall and thus defining a central cylindrical passage channel 3 that extends over the length of the hose. Injection liquid can be introduced into the passage channel 3 from one or both ends of the invention hose 1 or optionally also at connections provided between the ends, in order to distribute the injection liquid over the length of a joint that is to be sealed and is assigned by the injection hose 1. Four depressions 4, 5, 6 and 7, which extend over the entire length of the base body 2, are provided at identical angular intervals around the circumference of the base body 2. To produce a flow connection between the passage channel 3 and the depressions 4, 5, 6, 7, the hose wall has radial openings 8, 9, 10 and 11, which are distributed over the length of the hose and which open, on the one hand, into the passage channel 3 and, on the other hand, into the depressions 4, 5, 6 and 7. Disposed in the depressions 4, 5, 6 and 7 are respective strips 12, 13, 14 and 15, which are made of a reversibly compressible material and whose shape is complementary to the shape of the depressions 4, 5, 6 and 7. The base body 2 and the strips 12, 13, 14 and 15 which are disposed in the depressions 4, 5, 6 and 7 and which have outer surfaces substantially flush with the outer circumference of the base body 2, are enveloped by a hose 16 made of a thin liquid-permeable material or a material that dissolves under the effect of the injection liquid. In this manner the strips 12, 13, 14, and 15 are held securely in their depressions 4, 5, 6 and 7, even if the pressure of the injection liquid is applied from the inside. Concrete components are reliably prevented from penetrating from the outside through the openings 8, 9, 10 and 11 into the passage channel 3, since with the pressure raised from the outside the strips 12, 13, 14 and 15 merely close even better then openings 8, 9, 10 and 11 that are arranged in longitudinal rows. If, in contrast, the injection liquid pushes from the passage channel 3 from the inside outwardly against the strips 12, 13, 14, and 15, such strips are compressed due to the nature of the material thereof, and the joints between the surfaces bordering the depressions 4, 5, 6 and 7 and the strips 12, 13, 14 and 15 are expanded in such a manner that the injection liquid can issue from the injection hose 1 uniformly over its length and its circumference into the joint to be sealed.

Following hardening of a building material, e.g. concrete, defining a joint and following completion of the relaxation behavior typical of the building material, injection liquid is injected into the passage channel 3 of the injection hose 1. The injection liquid flows through the exit openings 8, 9, 10, 11 into the surrounding environment of the joint, in order to seal the joint. Following such injection, the not yet hardened injection liquid remaining in the injection hose 1 is drawn off by application of a negative pressure through the passage channel 3. In so doing, the strips 12, 13, 14, and 15 lying in the depressions 4, 5, 6 and 7 are pulled inwardly due to the negative pressure generated within base body 2 and thus close the openings 8, 9, 10 and 11. Thereby, the interior of the injection hose 1 is sealed with respect to the joint, and the injection liquid that has escaped from the injection hose during injection is not sucked back into the injection hose 1. The injection material is sucked out of the injection hose 1, e.g., with a vacuum system. Subsequently, the injection hose 1 is rinsed with rinse water until the rinse water is clear and no longer exhibits any traces of injection material. Thereafter, compressed air is blown through the injection hose 1 in order to remove as completely as possible the rinse water from the injection hose 1. Thus, the hose is suitable for post-injection operations.

After the original injection liquid which has escaped into the joint region has hardened, e.g. after two hours, further injection liquid can be post-injected. By the application of fresh grout of such post-injection operation, other joint regions, which remained eventually without any grout and which the original injection material could not yet reach, e.g. due to leaks during the first injection process, can be filled. Then the injection hose 1 is cleaned again in the manner described above. Following hardening of this injection liquid in the joints, a further post-injection operation can be conducted, but preferably at a raised pressure. In this manner, previously non-injected regions in the vicinity of the injection hose 1 can be filled individually, even small pores or structural defects.

Following emptying of the injection hose 1 of injection liquid, joints can be tested with water for imperviousness. To this end, water is injected into the emptied injection hose 1 preferably with a pressure corresponding to the construction site. The pressure is maintained over a prolonged period of time, e.g. several days. Leakages in the construction joints can be recognized by the eventual escape of water. If such leaks occur, further sealing can be effected with injection of material during renewed post-injection operations.

Water-miscible, reactively hardenable synthetic resins, vinyl ester-based resins, ultrafine mortar with liquid additives, polyurethane resins, silicate mortar-based liquids can be used as the injection liquid. The two first aforementioned injection liquids are water soluble in the fresh state, so that emptied injection hoses and apparatuses can be cleaned by rinsing with water and are then perfectly suitable for post-injection, should it be necessary. Polyurethane resin is not water soluble, so that cleaning the injection hose 1 is difficult. Such injection resin should be post-injected within its curing time, i.e. before the polyurethane hardens. For individual injections, various different injection liquids are used. Furthermore, the volume of the injection resin can be increased by swelling upon contact with water, thus achieving additional reliability with respect to the later expansion of the joints, e.g. through settling.

With the process according to the invention, construction joints with a width greater than 0.1 mm can be sealed.

What is claimed is:

1. A process for sealing a structural joint by use of an injection hose including a substantially liquid-impermeable elongated base body enveloping a passage channel and having distributed over the length thereof a plurality of openable and closeable exit openings extending from said passage channel through said base body, said process comprising:

injecting a hardenable injection liquid under positive pressure through said passage channel, thereby opening said exit openings, and then through the thus opened said exit openings into said joint and thereby sealing said joint;

before the thus injected said injection liquid hardens, applying negative pressure to said passage channel to thereby withdraw from said passage channel injection liquid remaining therein, and thereby causing said exit openings to close and preventing injection liquid in said joint from entering into or returning through said exit openings; and then injecting additional injection liquid, under positive pressure greater than said positive pressure at which said injection liquid is first injected, through said passage channel, thereby again opening said exit openings, and then through the thus reopened said exit openings into said joint, thereby further sealing said joint with said additional injection liquid.

2. A process as claimed in claim 1, further comprising, after said withdrawing, introducing water into said passage channel.

3. A process as claimed in claim 2, comprising rinsing said passage channel with said water.

4. A process as claimed in claim 3, further comprising blowing compressed air through said passage channel to remove water therefrom.

5. A process as claimed in claim 2, wherein said water is injected into said passage channel under positive pressure.

6. A process as claimed in claim 5, comprising maintaining said water under said positive pressure over a prolonged period of time and thereby testing for leakage of said joint.

7. A process as claimed in claim 5, further comprising blowing compressed air through said passage channel to remove water therefrom.

8. A process as claimed in claim 1, wherein said injection liquid is a synthetic resin that hardens reactively and can be mixed with water, a resin based on vinyl ester, a polyurethane resin, an ultrafine mortar with a liquid additive, a silicate mortar based liquid or an epoxy resin.

9. A process as claimed in claim 8, wherein said injection liquid is said polyurethane resin and is injected only within a curing time thereof.

10. A process as claimed in claim 1, wherein said injection liquid and said additional injection liquid are different materials.

* * * * *